United States Patent [19]

Boorsma

[11] Patent Number: 4,537,309

[45] Date of Patent: Aug. 27, 1985

[54] TAMPER RESISTANT AND TAMPER EVIDENT SEALED END CARTONS

[75] Inventor: Nancy B. Boorsma, Penfield, N.Y.

[73] Assignee: Pennwalt Corporation, Philadelphia, Pa.

[21] Appl. No.: 532,861

[22] Filed: Sep. 16, 1983

[30] Foreign Application Priority Data

Sep. 10, 1982 [JP] Japan ..... 57-137569

[51] Int. Cl.[3] ..... B65D 5/42; B65D 77/22; B65D 55/02

[52] U.S. Cl. ..... 206/525; 206/807; 206/621; 229/37 R

[58] Field of Search ..... 206/525, 807, 624, 628, 206/621; 229/37 R

[56] References Cited

U.S. PATENT DOCUMENTS

| | | | |
|---|---|---|---|
| Re. 26,402 | 6/1968 | Rumberger | 229/37 |
| 1,987,647 | 1/1935 | Wellman | 229/37 |
| 2,485,235 | 10/1949 | Graf | 93/36.8 |
| 2,830,505 | 4/1958 | Guyer | 93/36.8 |
| 3,126,143 | 3/1964 | Hager | 229/37 |
| 3,511,431 | 5/1970 | Silver | 229/37 R |
| 3,949,931 | 4/1976 | Hall | 206/807 |
| 4,434,896 | 3/1984 | Beloate et al. | 206/807 |

*Primary Examiner*—William T. Dixson, Jr.

[57] ABSTRACT

An extension is provided at each end of a glue flap of a conventional carton blank, the extensions being glued to conventional carton dust flaps to thereby provide improved tamper resistance to a sealed end carton when intrusion is attempted along glue seam for purposes of violating the contents, i.e. pharmaceutical products and the like, contained within primary packaging contained within the carton (secondary packaging). The extensions prevent withdrawal of the dust flaps to which the extensions are glued after the glue seam is penetrated. If the dust flaps are forcibly withdrawn, positive visual indication of tampering will result to thereby alert a potential consumer.

12 Claims, 7 Drawing Figures

TAMPER RESISTANT AND TAMPER EVIDENT SEALED END CARTONS

STATEMENT OF THE INVENTION

The present invention relates to cartons for packaging drug products and the like and more particularly concerns sealed end cartons providing improved resistance to intrusion along a side seam thereof and positive visual indication of such intrusion.

BACKGROUND AND SUMMARY OF THE INVENTION

Recent incidents of tampering with drug and food products in cartons have spurred the Food and Drug Adminstration into requesting more tamper resistant-/evident packaging. Industry and the FDA are presently cooperating in joint efforts to expeditiously provide appropriate packaging for drug products and the like which will readily yield visual indication of intrusion. The present invention provides an improved tamper-resistant/evident sealed end carton which will positively indicate entry along the glued seam thereof without adding additional cost to the customer or carton manufacturer. Further, current carton forming equipment need not be modified to produce the improved carton of the present invention.

Many present day carton blanks are conventionally cut and scored to have front, rear, and side wall panels. An end panel will include a glue flap which is glued to the other end panel of the carton blank to thereby form a four-sided carton. Typically, the dust flaps are conventionally folded, one atop the other, and one of two closure flaps folded thereover. The remaining closure flap is then glued over the folded closure flap to provide a conventional sealed-end carton.

It should be apparent from the above description that one bent on intruding into a conventional sealed-end carton could readily separate the glue flap from the panel to which it is glued, carefully unfold the panel to which the glue flap is glued to withdraw the dust flaps accompanying that panel, refold that panel to which the glue flap is glued into the carton by inserting the dust flaps at each end of that panel into dust flapping relationship, and finally regluing the glue flap, the entire intrusion leaving no or little visible evidence thereof. Since a glue flap is necessarily glued to the other end panel of the blank and the glue lap extensions of the present invention glued to the dust flaps of said other end panel, it is apparent that the closure flap will conceal the glue lap extensions which will therefore not be visible to one intruding or attempting to intrude into the carton along the glue lap seam. Intrusion into the carton by means of the glue lap seam will result in a tearing or slitting of the panel to which the glue lap is glued or the dust flap or flaps from that panel, to thereby provide a positive visual indication of tampering or intrusion, despite careful regluing.

BRIEF DESCRIPTION OF THE DRAWINGS

FIG. 5 is a fragmentary perspective view of a partially completed carton formed from the blank of FIG. 4, containing capped bottle containing drug product or the like.

DETAILED DESCRIPTION OF THE INVENTION

Figure 1:
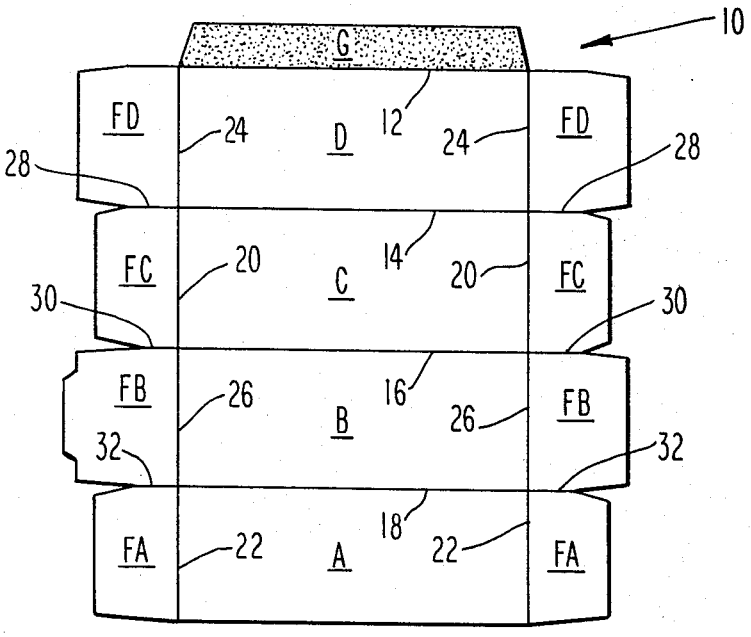
PRIOR ART Fig. 1
FIG. 1 is a plan view of a typical scored carton blank for forming a conventional sealed and carton.
Figure 2:
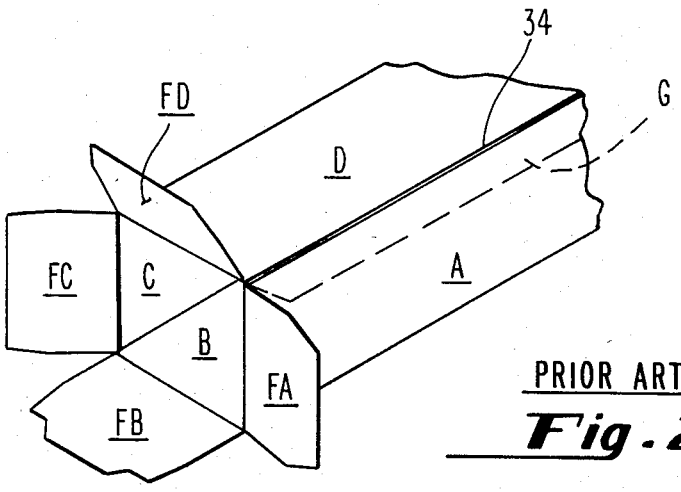
PRIOR ART Fig. 2
FIG. 2 is a fragmentary perspective view of a partially completed conventional carton formed from the blank of FIG. 1.

In FIG. 1, a conventional scored carton blank 10 includes wall panels A, B, C and D; dust flaps FC and FA, extending from ends of wall panels C and A respectively; closure flaps FD and FB, extending from ends of panels D and B respectively; and glue flap G, extending along the outer length of wall panel D. Glue flap G is folded inwardly along score line 12, and is glued by conventional means to an inner surface of wall panel A (FIG. 2) to form an open-ended four-sided enclosure by virtue of score lines 14, 16 and 18 demarcating the several wall panels.

Figure 3:
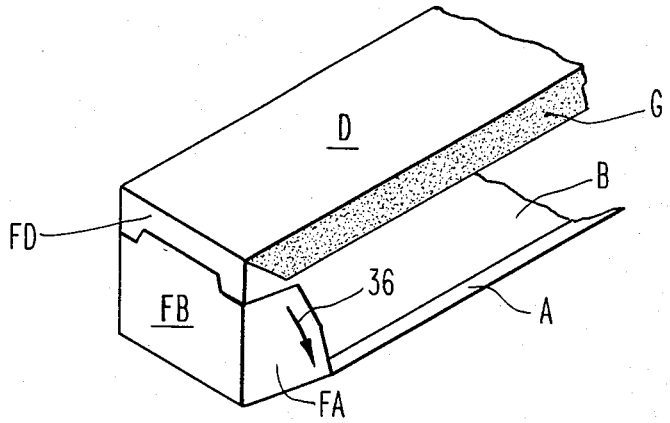
PRIOR ART Fig. 3
FIG. 3 is a fragmentary perspective view of a completed conventional carton after partial intrusion along the glue flap or side seam thereof.

Dust flaps FC and FA, and closure flaps FD and FB are respectively foldable along score lines 20, 22, 24 and 26 by virtue of cut lines 28, 30 and 32. Dust flaps FC and FA may thus be folded over the four-sided enclosure, and closure flap FD folded thereover. The remaining closure flap FB may then be folded to overlay closure flap FD (FIG. 3). Closure FB is glued onto closure flap FD by conventional means, the entire sealed end carton comprising a typical secondary carton packaging means employed in the pharmaceutical industry.

The dust flaps are preferably, although not necessarily, in partial overlapping relationship while the closure flaps overlap each other in order for one to be glued onto the other (FIG. 3). The primary packaging carried within the sealed end carton may comprise a capped bottle, ointment tube, pouched product, etc., for example, containing a pharmaceutical product and the like.

It should be apparent that a person intent on intruding into the secondary packaging in order to violate the contents of the primary packaging can readily insert a suitable knife blade and the like into the glue lap seam 34 (FIG. 2) where glue flap G and panel A are glued together, and by careful manipulation of the blade to successfully separate the glue flap G from wall panel A. Next, by merely unfolding panel A (in the direction indicated by arrow 36 of FIG. 3), closure flaps FA may readily be withdrawn from the carton ends to thus render vulnerable the contents of the primary packaging means (not shown). By simply reinserting the dust flap FA into proper position and regluing glue flap G to panel A, indication of tampering may easily pass undetected.

Figure 4:
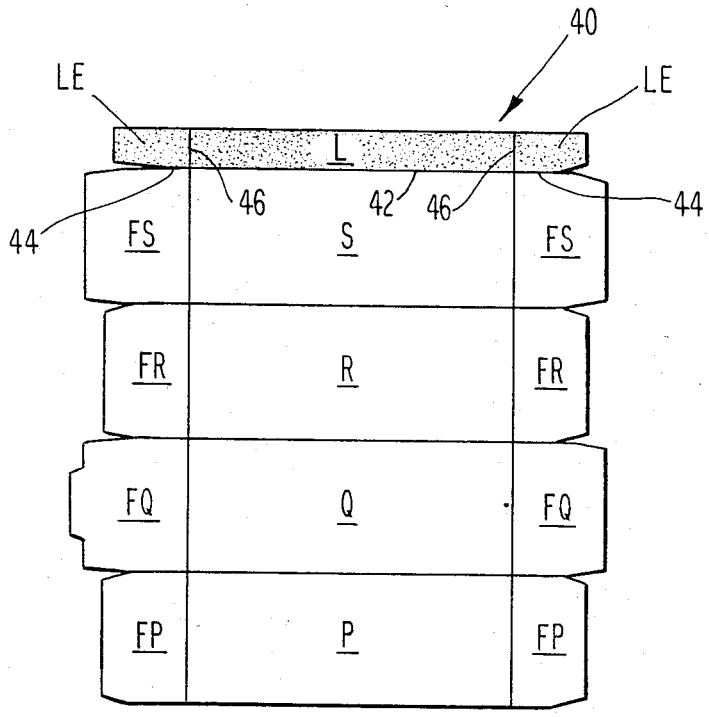
FIG. 4 is a plan view of a scored carton blank for forming the tamper resistant/evident sealed end carton of the present invention.

Reference is now made to FIG. 4 of the drawings which illustrates a scored carton blank 40 for forming the tamper resistant/evident carton of the present invention. Blank 40 may be identical with conventional carton blank 10 with the exception of the glue lap L now including an extension LE at each end thereof. Score line 42 permits glue lap L to be folded from wall panel S, while cut lines 44 permit the glue lap extensions LE to be folded along score lines 46 together with dust flaps FP, extending from the ends of wall panel P. Similarly, dust flaps FR extend from ends of wall panel R and closure flaps FS and FQ extend from ends of wall panels S and Q respectively. Score lines permitting the wall panels to form a four-sided open-ended enclosure and the flaps to be individually folded over the open ends of the enclosure may be identical to the score lines of the conventional sealed and carton aforedescribed.

Figure 5:
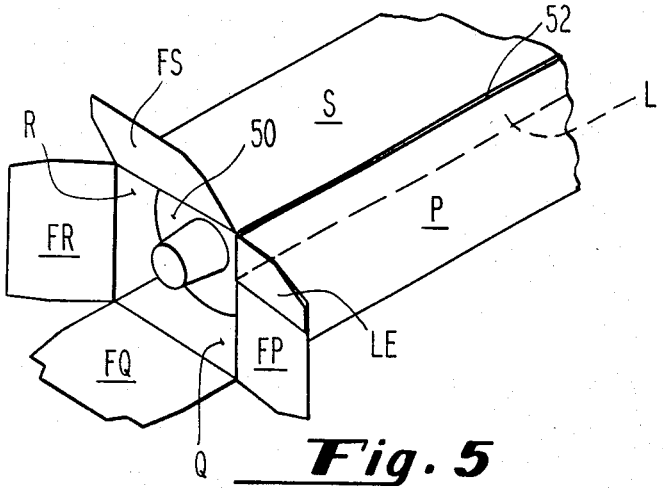
Figure 6:
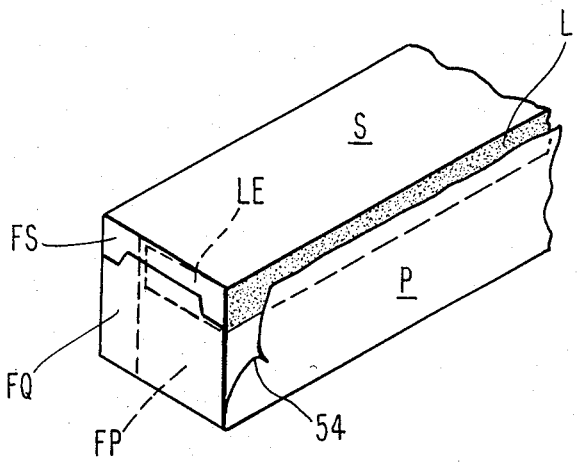
FIG. 6 is a fragmentary perspective view of a complete carton of the present invention showing typical evidence of intrusion or attempted intrusion thereinto by means of the glue lap seam.

Referring now to FIG. 5, extensions LE are glued to respective dust flaps FP and are foldable therewith. All flaps are folded to form a sealed end carton in the manner described with reference to the conventional carton above discussed, i.e., dust flap FP is foled over dust flap FR (the sequence may be reversed) and closure flap FS folded thereon. Closure flap FQ is then glued over closure flap FS (FIG. 6).

An intruder intent of violating the pararmaceutical contents of capped bottle 50 may insert a knife blade in glue lap seam 52 to separate panel P from glue lap L. Any attempt however to then unfold panel P to withdraw its dust flaps FP will result, in all likelihood, to damage of panel P as represented typically by tear 54 which will indicate to a potential consumer that the contents of capped bottle 50 may have been tampered with, notwithstanding careful regluing of panel P. In lieu of bottle 50, a plastic bag or container, ointment tube, pouched product, and the like, may comprise the primary packaging means.

Figure 7:
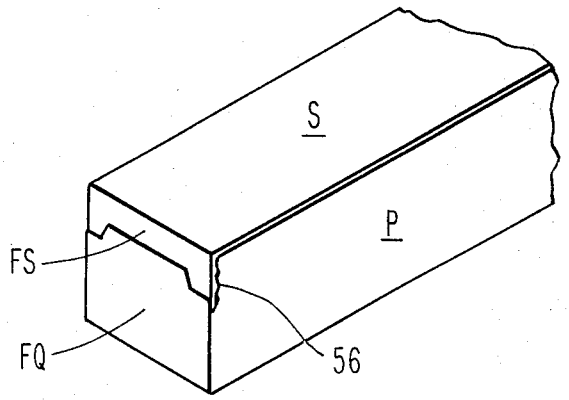
FIG. 7 is a fragmentary perspective view of a completed carton of the present invention illustrating evidence of intrusion by means of its glue lap or side seam after efforts to restore integrity to the carton.

Even if panel P is not torn by the intruder, it cannot be successfully unfolded to withdraw its dust flaps FP due to glue lap extension LE secured thereto, thereby providing a more tamper-resistant carton when intrusion is attempted along the glue lap seam 52. And if an intruder should inadvertently tear panel P from one of its dust flaps FP due to the gluing thereto of a glue lap extension LE, indication of such tampering will be evident from the irregular appearance of the reglued panel as indicated by numeral 56 in FIG. 7.

It is appreciated that the glue lap extensions are not visible whether dust flaps FP are the first or second dust flaps to be folded.

An adhesive label over the glue lap seam 52 would discourage intrusion therealong. Labeling, however, detracts from the carton's graphics as well as increasing cost to the consumer.

It is further appreciated that the present invention is not directed to end intrusions which may be deterred by labels or seals sealing the closure flaps FQ and FS. Labels and seals however, suffer the disadvantage abovementioned.

I claim:

1. In a product including secondary packaging means comprising a carton wherein one of four wall panels is provided with a glue lap for gluing to an interior surface of another of said four wall panels to form a rectangularly shaped carton having a glue lap seam, said carton including a pair of opposed dust flaps foldable and folded toward each other and provided at ends of a pair of opposing wall panels, a first closure flap provided at each end of another of said four wall panels for folding over said folded dust flaps, a second closure flap extending from each end of remaining of said four wall panels for overlapping said first closure flaps and glued thereto, and primary packaging means contained within said carton, said primary packaging means containing a consumable product therein, in combination, the improvement comprising an extension provided at each end of said glue lap, each of said extensions glued to a respective dust flap extending from said panel to which said glue lap is glued, said extensions foldable with said dust flaps, said carton providing tamper resistance to intrusion thereinto via said glue lap seam and visual evidence of said tampering upon physical separation of said glue lap from said wall panel carrying said dust flaps with said glue lap extensions.

2. The product of claim 1 wherein said consumable product is a pharmaceutical or medicinal product.

3. The product of claim 1 wherein said consumable product is contained within a capped bottle, ointment tube, pouched product, and the like.

4. The product of claim 1 wherein said carton is devoid of powder, particles and flakes in direct contact therewith.

5. The product of claim 1 wherein said primary packaging means is a capped bottle, ointment tube, pouched product, and the like.

6. The product of claim 1 wherein said primary packaging means is a plastic bag and the like.

7. Combined product of primary and secondary packaging, said primary packaging containing a pharmaceutical product and the like, said primary packaging contained within said secondary packaging, said secondary packaging comprising a rectangularly shaped carton formed from a carton blank having 4 wall panels and flaps at each end of each of said wall panels, said wall panels comprising a first outer panel, a first inner panel, a second inner panel and a second outer panel, a glue lap extending along a portion of length of said first outer panel for gluing to inner surface of said second outer panel, said flaps which extend from said first outer panel and second inner panel comprising opposed dust flaps, said flaps which extend from said first inner panel and said second outer panel comprising closure flaps, said dust flaps folded toward each other and said closure flaps folded thereover, said closure flaps extending from said second outer panel glued to closure flaps extending from said second inner panel, the improvement to said carton for rendering said carton more tamper resistant to intrusion therewithin, said intrusion occurring along a seam formed by said glue lap and second outer panel, said improvement comprising an extension at each end of said glue lap, one of said extensions glued to a dust flap extending from said second outer panel and other of said extensions glued to other dust flap of said second outer panel, whereby intrusion along said glue lap seam for entry within said carton provides visual indication or evidence of said intrusion.

8. Process for rendering a conventional rectangularly-shaped seal end carton more tamper-resistant when intrusion is initiated along glue lap seam thereof and tamper evident after said intrusion, said carton formed from a conventional carton blank including a glue lap, four panels, and flaps extending from ends of each of said panels, said flaps comprising a pair of opposed dust flaps at each end of said carton and a pair of opposed closure flaps at each end of said carton, the improvement to said carton for rendering it more tamper-resistant/evident comprising the steps of extending said glue lap at each end thereof to form glue lap extensions, gluing one of said glue lap extensions onto a dust flap of said panel to which said glue lap is glued, gluing other of said glue lap extensions onto other dust flap of said panel to which said glue lap is glued, end sealing said carton after inserting primary packaging therewithin, said primary packaging containing a pharmaceutical product and the like, said end sealing step including steps of gluing one of said closure flaps from each end of said carton extending from same panel onto other of said closure flaps at each end of said carton which overlay each pair of said opposed dust flaps.

9. The process of claim 8 wherein said primary packaging comprises a capped bottle, ointment tube, pouched product, plastic bag, and the like.

10. The process of claim 8 wherein each of said glue lap extension extends substantially the length of said dust flap to which said glue lap extension is glued.

11. Process for using a siftproof carton to contain primary packaging therein such as a capped bottle and the like for containing a pharmaceutical product and the like, said process rendering said carton more tamper resistant when intrusion is initiated along a glue lap seam thereof and more tamper evident when intrusion is effected along said glue lap seam, said carton formed from a conventional carton blank including a glue flap, four panels, and flaps extending from ends of each of said panels, said flaps extending from ends of each of said panels comprising a pair of opposed dust flaps at each end of said carton and a pair of opposed closure flaps at each end of said carton, an extension along said glue flap at each end thereof, said extensions glued to said dust flaps extending from a panel to which said glue flap is glued, said glue flap and said panel glued thereto forming said glue lap seam and a four-sided enclosure, said process comprising the steps of inserting said primary packaging within said enclosure, end sealing said carton with said primary packaging therewithin, said end sealing step including steps of gluing one of said closure flaps from each end of said carton extending from same panel onto other of said closure flaps at each end of said carton which overlay each pair of said opposed dust flaps.

12. Process claim 11 wherein said primary packaging is inserted into said carton after one end thereof has already been end sealed.

* * * * *